United States Patent [19]

Piester

[11] 4,299,174

[45] Nov. 10, 1981

[54] HOPPER CAR COVER SYSTEM

[76] Inventor: George Piester, 608 N. Kearney Ave., Minden, Nebr. 68959

[21] Appl. No.: 132,155

[22] Filed: Mar. 20, 1980

[51] Int. Cl.[3] ..... B60J 7/00

[52] U.S. Cl. ..... 105/377; 52/45

[58] Field of Search ..... 105/377; 296/100; 292/125, 133, 225; 52/47, 53, 55; 220/1.5, 72, 323, 324; 150/52 R; 206/508

[56] References Cited

U.S. PATENT DOCUMENTS

| | | | |
|---|---|---|---|
| 2,985,118 | 5/1961 | Maharick et al. | 105/377 |
| 3,327,649 | 6/1967 | Fisher et al. | 105/377 |
| 3,854,771 | 12/1974 | Anderson | 105/377 |
| 3,994,240 | 11/1976 | Berg et al. | 105/377 |

*Primary Examiner*—Richard A. Bertsch

*Attorney, Agent, or Firm*—Robert A. Ostmann

[57] ABSTRACT

The disclosure concerns a removable, rigid cover system for railway hopper cars. The system employs a set of welded, steel roof sections which are bolted together end-to-end through upstanding flanges, and which are attached to the car by J-bolts which engage the outturned flanges at the upper margins of the side and end walls of the car. The sections have depending exterior skirts which, in the aggregate, envelope the car and serve to prevent entry of water and to shield the J-bolts from damaging impacts. The section may also have depending interior skirts which act as dams to minimize escape of grain from the car. The system also includes hatchways with hinged covers which facilitate loading of the car, and a walkway.

14 Claims, 7 Drawing Figures

HOPPER CAR COVER SYSTEM

BACKGROUND AND SUMMARY OF THE INVENTION

Today, in the United States, railway grain cars are in short supply, and elevator managers all over the Midwest are suffering from an inability to move their grain to terminal elevator facilities. The severe shortage of grain storage space makes attractive use of open top hopper cars, which normally are employed in hauling coal, and which commonly are available. This alternative service of coal cars, of course, necessitates use of a cover for protecting the grain from water damage and wind loss, and the prior art contains various proposals for removable cover systems. Although some of these proposals are available commercially, none of them, in my opinion, is entirely satisfactory.

The object of this invention is to provide an improved removable cover system for converting an open top hopper car into an acceptable grain-hauling car. This new cover system is characterized by various important features, the more notable of which are:

1. It is made of easily fabricated metal components joined, as far as practicable, by welding. Thus the system is economical and is more durable and more reliable than the tarpaulin type covers which some have proposed.

2. The system consists of sections, each of which spans the width of the hopper car, which are bolted together end-to-end to span the car's length. The arrangement makes it a simple matter to accommodate the wide variety of car sizes presently used by the U.S. railroads. It also enables the cover to be installed and removed relatively easily by a small crew equipped with common tools and aided by a trackside crane of reasonable capacity.

3. The sections of the cover are secured to the car by J-bolts which engage the outturned flanges at the upper margins of the side and end walls of the car. Therefore, the system complies with the regulations of the Association of American Railroads (known as the AAR), which prohibit drilling or welding of the car body. Moreover, the attachment scheme precludes undue displacement of the cover under normal service conditions, yet accomodates the small relative displacements attributable to deflection and twisting of the car during transit. The scheme also permits, with only minor damage, the substantial displacements of the cover which can occur as a result of large impact loads, such as those which may be encountered in a derailment.

4. The sections carry depending, exterior skirts which project downward below the upper margins of the car walls, and which, in the aggregate, envelope the perimeter of the car. This feature minimizes entry of rain, sleet, or snow. In addition, these skirts enclose from the outside the J-bolts, and thereby protect those components from damaging impacts with obstruction which are encountered along a right-of-way, particularly on sidings.

5. The roof sections preferably also are provided with interior depending skirts which serve as dams which minimize escape of grain during filling of the car and also when the car is in transit.

6. The cover sections employ an arched design which increases the hauling capacity of the cars and makes them comparable to covered grain cars.

7. All sections are provided with walkways, and all except very short sections are equipped with hatchways having hinged covers. Therefore, cars covered with these sections may be filled and handled just as easily as standard grain cars. The preferred hatchways are unusually easy to construct, yet they afford adequate insurance against entry of water and escape of grain.

BRIEF DESCRIPTION OF THE DRAWINGS

Several embodiments of the invention are described herein with reference to the accompanying drawings, in which.

DESCRIPTION OF ILLUSTRATED EMBODIMENTS

Figure 1:
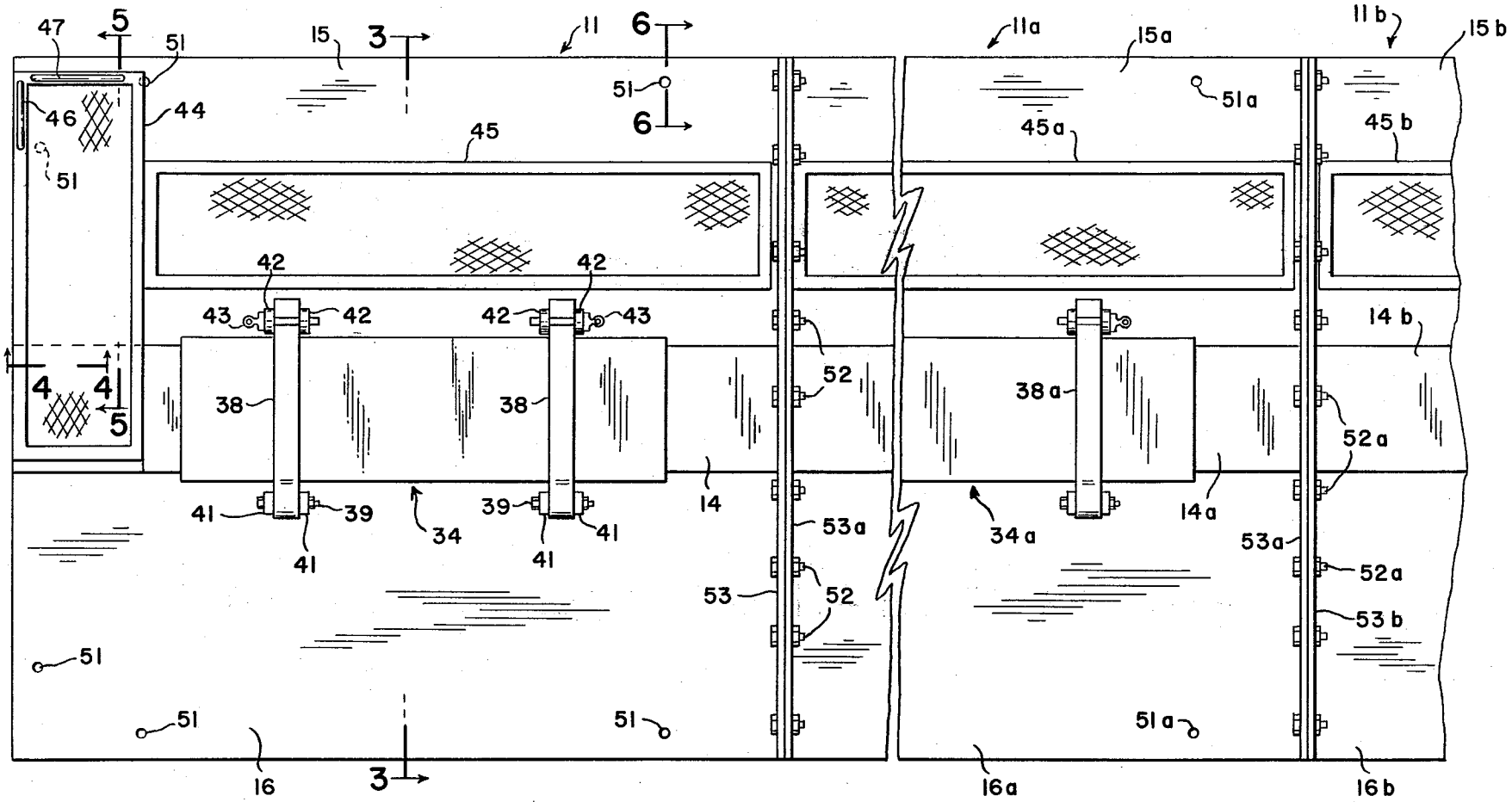
FIGS. 1 and 2 are top and bottom plan views, respectively, of a portion of the preferred cover system.
Figure 2:
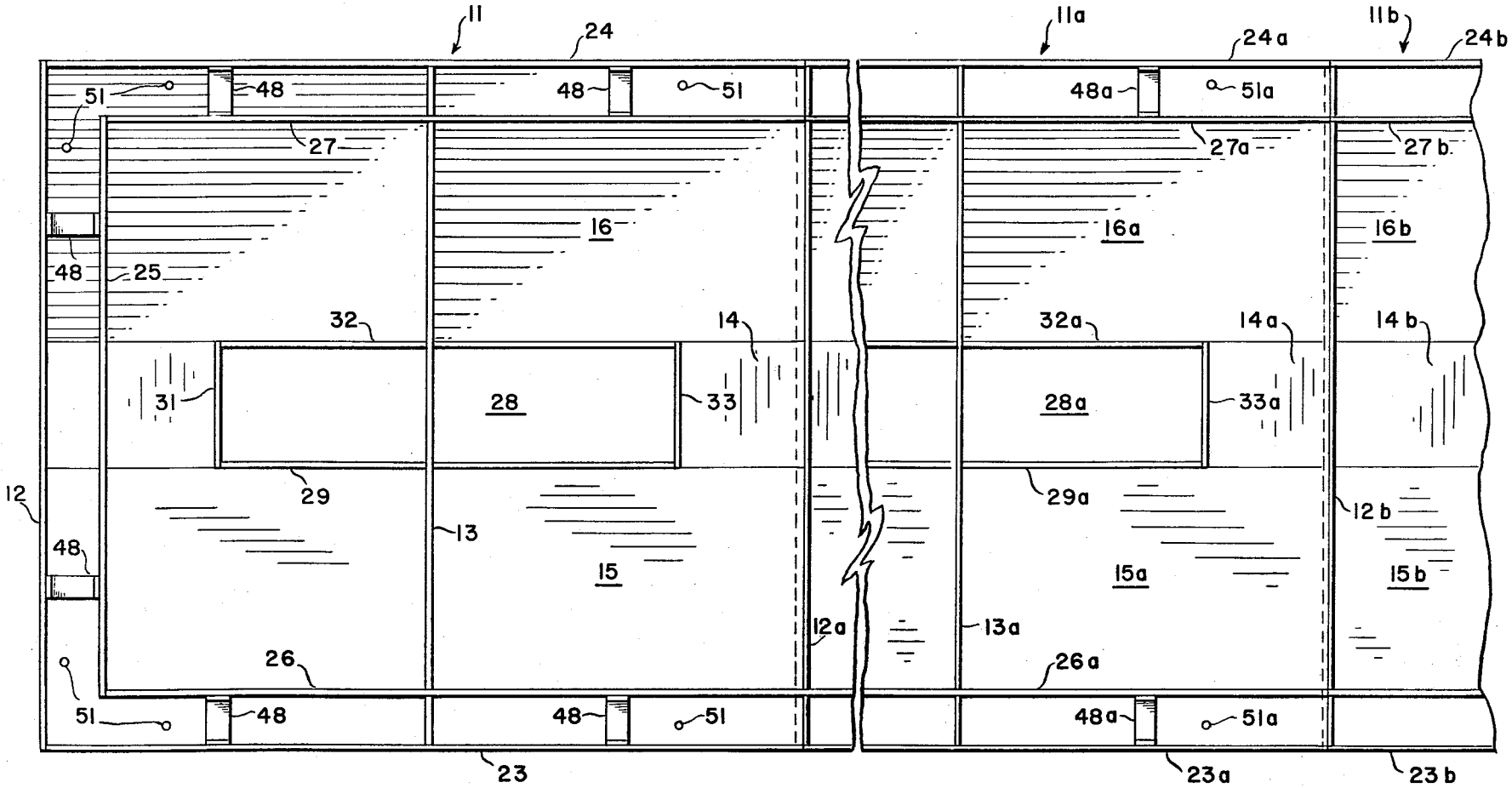

Referring to FIGS. 1 and 2, the improved cover system comprises a pair of similar end roof sections 11, only one of which is shown, and at least one intermediate section, usually several such sections **11*a* and 11*b***. Except as noted, the sections are made from 12 gauge, flat steel components which are joined by welding.

End section 11 comprises a pair of transverse rafter plates 12 and 13 of generally trapezoidal form, and overlying roofing plates, and define a roof having a horizontal center panel 14 which is flanked by downward sloping side panels 15 and 16. Rafter plate 12 extends across the outboard end of section 11 and is dimensioned to provide an integral skirt portion 17 which lies outside the end wall 18 of the car (see FIG. 4) and which depends below the upper margin 19 of that wall a distance of 5" to 6". Rafter plate 13, on the other hand, is located in a central region of roof section 11, and has a vertical dimension so chosen that its lower edge is spaced upward from the upper margins 21 of the side walls 22 of the car (see FIG. 3). Each of the sloping panels 15 and 16 is provided with a depending skirt 23 or 24 which extends longitudinally along its outboard or free edge and which is positioned to lie outside the adjacent side wall 22 of the car. These skirts depend below the upper margins 21 of the side walls 22 to the same extent as end skirt portion 17 depends below the upper margin 19 of the car's end wall 18. Skirts 23 and 24 butt skirt portion 17 at the corners, so that the adjacent perimenter of the car is completely enveloped. This skirting arrangement prevents entry into the car of driven rain, sleet and snow.

Figure 3:
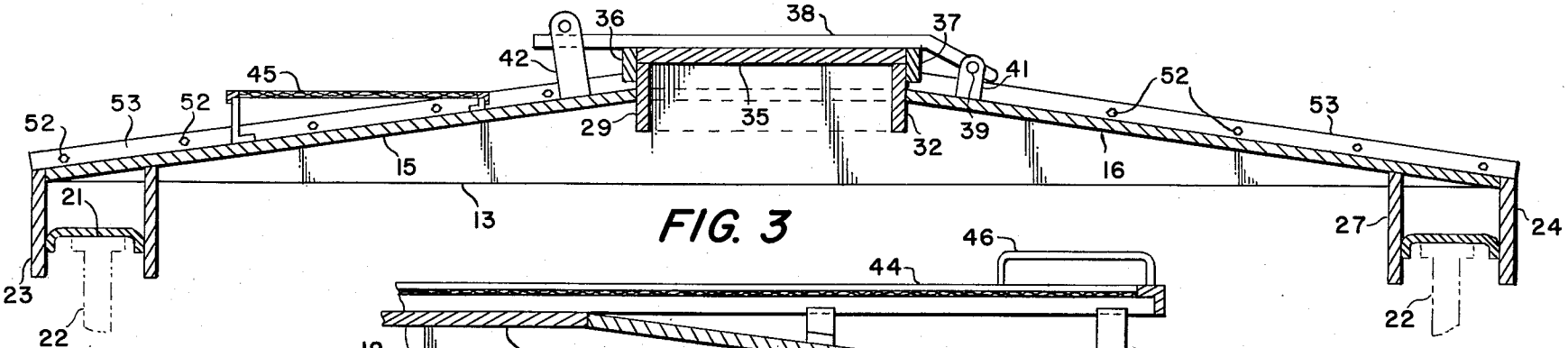
FIGS. 3–6 are sectional views, on enlarged scales, taken on lines 3—3 to 6—6, respectively, of FIG. 1.
Figure 5:
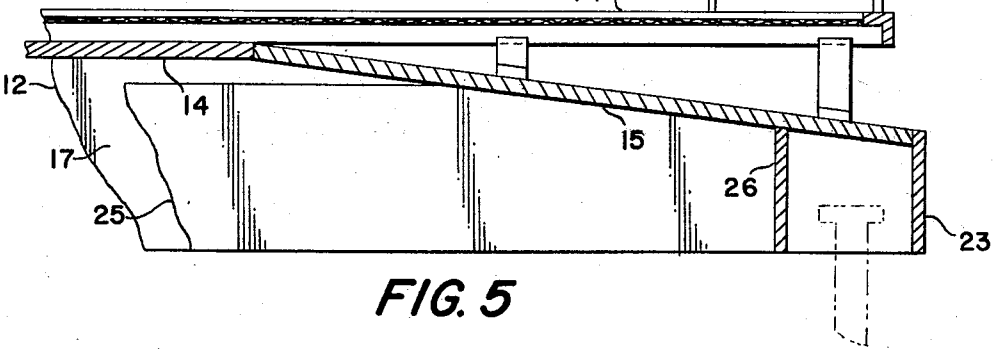
Figure 4:
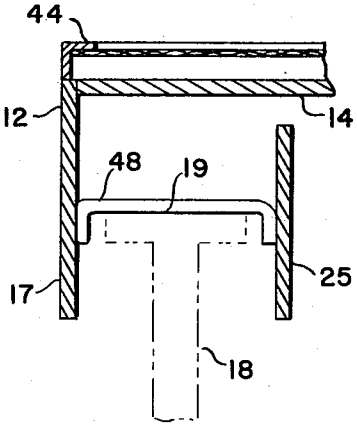

The end roofing section 11 also is equipped with an interior skirting arrangement consisting of a transverse depending skirt 25, and a pair of longitudinal depending skirts 26 and 27. These interior skirts 25–27 are parallel with exterior skirts 17, 23 and 24, respectively, and, as shown in FIGS. 3–5, they are located inside the adjacent end and side walls of the car and project below the upper margins of those walls. Longitudinal skirts 26 and 27 are notched to fit over central rafter plate 13, and they butt against transverse skirt 25 at the corners. The interior skirting scheme defines a dam which prevents escape of grain from the car during filling operations, when the grain is blown into the car, as well as during transit, when the car is jostled or subjected to impacts (caused for example, by coupling or "humping"). As indicated in FIG. 5, the escape-impeding function of skirt 25 does not require that this skirt extend upward all the way to center panel 14 because the car usually is not completely filled with grain.

Center roof panel 14 contain a centrally located rectangular opening 28 defining a hatch through which the car is loaded. The opening is bounded by four vertical plates 29, 31, 32 and 33 which project both upward and downward about 3" to 4" from panel 14. Plates 29 and 32 are notched to fit over rafter plate 13. The depending portions of the four plates serve as a dam which impedes escape of grain. The hatch is equipped with a hinged cover 34 comprising a cover plate 35 surrounded by four depending skirts, two of which are indicated by numerals 36 and 37 in FIG. 3, which lie along the outside faces of the plates 29, 31, 32 and 33. The overlapping relationship of these members provides an effective barrier against entry of water, sleet or snow into the car. Cover 34 is carried by a pair of straps 38, one end of each of which is bent downward and is formed into a loop which receives a bolt type hinge pin 39 carried by lugs 41 attached to sloping roof panel 16. The opposite end of each strap 38 is adapted to rest between a pair of locking lugs 42 attached to sloping panel 15 and be held captive by an overlying locking pin 43 which passes through those lugs. To prevent loss, pins 43 should be permanently fixed to the cover section, as by chains (not shown). In accordance with AAR requirements, the hatchway is so positioned and dimensioned that its cover 34, when opened, does not overhang the side of the car.

Roof section 11 also carries a walkway comprising a transverse portion 44 located at the free end of the section, and a longitudinal portion 45 which extends along roof panel 15. If desired, portion 44 may extend across the full width of the section, and a duplicate longitudinal portion 45 may be carried by roofing panel 16. The walkway portions 44 and 45 comprise an expanded metal grating made of 9 gauge steel sheet having slits 1½" long, which is welded to an angle iron frame. Portion 44 is equipped with hand bars 46 and 47 at its outboard corner, and both portions are equipped with appropriate mounting feet through which they are bolted to the roofing panels.

Figure 6:
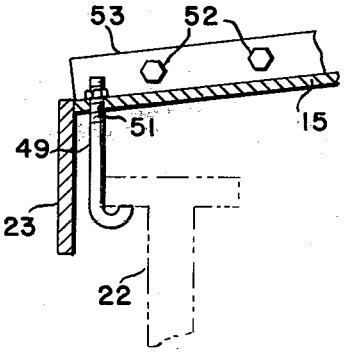

End section 11 is supported on the upper margins of the car walls by horizontal support straps 48 which extend between adjacent exterior and interior skirts 17,25; 23,26 and 24,27. The roofing section is attached to the car by J-bolts 49 having hook portions which engage the outturned flanges at the upper margins of the car's end and side walls, and threaded shanks which extend upward through openings 51 in the overlying roofing panels and are secured by nuts. As indicated in FIGS. 2 and 6, the J-bolts are located in spaces bounded at the outside by the exterior skirts 17, 23 and 24, and, therefore, they are effectively shielded from damaging impacts. In the case of roofing sections of the size mentioned herein, experience shows that it is sufficient to provide two support straps 48 and two J-bolts 49 at each side of the section, and two additional sets of these components at the free end. Roof section 11 is joined to the adjacent section 11*a* by a series of bolts 52 which pass through an upstanding flange 53 which extends across its inboard end and through a similar mating flange carried by the other section. This joint is sealed by a strip of sponge rubber (not shown) sandwiched between the two flanges.

Intermediate roof sections 11*a* and 11*b* are constructed generally in the same way as end section 11, so their corresponding parts are identified by the same reference numerals, with postcripts a and b added for clarity. The intermediate sections, however, do not include either a transverse walkway or transverse skirts analogous to skirts 17 and 25, and they are supported by and attached to the car only along their sides. Furthermore, the intermediate sections have an upstanding transverse flange 53*a* or 53*b* across each of their ends. In addition, in cases where the length of the intermediate section is less than about 8 feet, it is recommended that the hatchway be omitted.

Although the width of open top hopper cars used on American railroads is not uniform, the variations are small enough that they can be accommodated by a properly dimensioned roof section having a standard width. I have found that roof sections in which the distance between the longitudinal skirts 23 and 24 is 10'-10", and the distance between adjacent sets of internal and external skirts 23, 26 and 24, 27 is about 10" will fit properly all of the cars likely to be encountered. The variation in car length, however, is entirely different matter, because hopper cars came in a variety of sizes from just under 50' to as short as 27'. In my view, the best way to take account of this situation is to provide one set of end and intermediate sections having a standard length, for example, 11'-8", and a second set consisting of intermediate sections of different lengths selected to make up the difference between the lengthwise spans of the cars and a multiple of the standard length sections.

Figure 7:
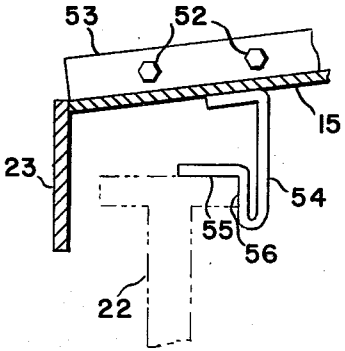
FIG. 7 is a sectional view through the side margin of a roof section showing an alternative support arrangement.

As already indicated, the interior skirts 25-27 of the preferred embodiment are desirable because they prevent escape of grain from the car. In addition, these skirts, in combination with the support straps 48, coact with the car walls to limit displacement of the cover sections relative to the car under normal service conditions. While interior skirts are considered the best means for performing these important functions, other apparatus may be used. For example, experience shows that another acceptable, though less convenient, way to impede escape of grain is to position rolls of reinforced grain door paper in the spaces at the sides and ends of the car bounded by the upper margins of the walls and the under sides of the roofing panels. In this version of the invention, as indicated in FIG. 7, the support straps are replaced by special straps 54 which are welded to the sloping roof panels and are formed to provide a horizontal surface 55 which rests upon the upper margins of the car walls and a vertical surface 56 which coacts with those walls to limit lateral and longitudinal displacement of the roof sections.

Since the roof sections have a generally arched shape in transverse cross section, and are supported at an elevation above the upper margins of the car walls, the cover system is able to effect a significant increase in the hauling capacity of the hopper car. In particular, it has been found that the grain-carrying capacity of hopper cars equipped with one real embodiment of this cover system was about 7,000-10,000 pounds greater than the capacity of their uncovered counterparts. As a result, the capacity of a converted open top hopper car is nearly the same as the capacity of a standard, covered grain car.

I claim:

1. A removable, rigid, metal roof section adapted to span the width of an open top railway hopper car and to be bolted to at least one another section and to the car to form a complete cover for such a car, the roof section comprising a. a series of longitudinally spaced, steel rafter plates arranged to extend transversely of said car and which are welded to overlying steel roofing plates to define a roof comprising a horizontal, planar center panal which is flanked by downward sloping, planar panels;

b. a depending, exterior, steel, planar skirt welded to and extending longitudinally along the outer margin of each sloping panel, c. the exterior skirts being positioned transversely to lie outside the side walls of the car and having heights such that they extend downward below the upper margins of said walls when the roof section is installed on a car;

d. steel support members welded to each sloping panel and having horizontal portions which rest on the upper margins of the side walls of the car and vertical portions which coact with said side walls to limit transverse displacement of the roof section when the latter is installed on a car;

e. a longitudinal series of bolt holes extending through each sloping panel and positioned to lie between the exterior skirt and the adjacent said wall of the car when the roof section is installed on a car;

f. a steel flange extending transversely across and projecting upward from at least one end of the roofing plates and containing a series of bolt holes;

g. a hatchway formed in the center panel and including a hinged cover; and h. a walkway extending longitudinally along and attached to at least one of the sloping panels.

2. A roof section as defined in claim 1 including a. a second exterior, depending, steel, planar skirt which extends transversely across one end of the section, b. the second exterior skirt being positioned to lie outside an end wall of the car and having a height such that it extends downward below the upper margin of said end wall when the roof section is installed on a car; and c. a transverse series of bolt holes extending through roof panels and positioned to lie between the second exterior skirt and said end wall of the car when the roof section is installed on a car.

3. A roof section as defined in claim 2 in which said second exterior skirt is formed in one piece with one of said rafter plates.

4. A roof section as defined in any one of claims 1–3 including a. a depending, interior, steel, planar skirt welded in place and extending longitudinally of each sloping panel and located inboard of said exterior skirt, b. the interior skirts being positioned transversely to lie inside the side walls of the car and having heights such that they extend downward below the upper margins of said walls when the roof section is installed on a car.

5. A roof section as defined in claim 4 in which said support members comprise a. said interior skirts; and b. a series of steel straps extending horizontally between each interior skirt and the adjacent exterior skirt and welded to those skirts.

6. A roof section as defined in claim 1 in which said support members comprise a series of longitudinally spaces strap members which are welded to each sloping panel.

7. A roof section as defined in claim 2 including a. a depending, interior, steel, planar skirt welded in place and extending transversely of the roof section, b. said interior skirt being positioned longitudinally to lie inside said end wall of the car and having a height such that it extends below the upper margin of said end wall when the roof section is installed on a car.

8. A roof section as defined in claim 1 in which the hatchway comprises a rectangular opening in said center panel bounded by planar, vertical walls which are welded in place and extend both upward and downward from the center panel.

9. A roof section as defined in claim 8 in which said hinged cover comprises a flat panel which rests upon the upper margins of said vertical walls, and planar, depending side walls which are welded along the sides and ends of the flat panel and lie adjacent the outside faces of said vertical walls which bound the opening in the center panel.

10. A removable, rigid, metal cover system for an open top railway hopper car having side and end walls provided with outward directed flanges at their upper margins and comprising a. a plurality of steel roof sections, each of which spans the width of the car, which join end-to-end to span the length of the car, b. there being two end sections and at least one intermediate section;

c. upstanding flanges carried by the sections and extending transversely across each end of said intermediate section and across the inboard end of each end section, the flanges of adjacent sections facing one another;

d. a first series of threaded fasteners, including bolts which extend through each pair of facing flanges, interconnecting the roof sections;

e. depending skirts carried by the sections and extending longitudinally along the side margins of each section and transversely across the outboard end of each end section, f. the longitudinal and transverse skirts being located outside and spaced from the side and end car walls, respectively, and depending below the upper margins of those walls; and g. a second series of threaded fasteners, including J-bolts, connecting the sections with said flanges of the car walls, h. the J-bolts being located in the spaces between the skirts of the sections and the car walls, having hook portions which engage the flanges of the car walls, and extending vertically through the roof sections.

11. A cover system as defined in claim 10 including a. an interior depending skirt carried by each end section which extends in the transverse direction and which is located inside and is spaced from the associated end wall of the car, b. the interior depending skirt projecting downward below the upper margins of the end walls of the car.

12. A cover system as defined in either of claims 10 and 11 including a. interior depending skirts carried by the sections, extending longitudinally of each section, and being located inside and spaced from the side walls of the car, b. the interior longitudinal skirts projecting downward below the upper margins of said side walls.

13. A cover system as defined in claim 12 in which each section includes a. transverse rafter plates to which are welded overlying roofing plates;

b. support means spearate from the rafter plates and which rest upon the upper margins of the car and support the section at an elevation at which the rafter plates are spaced vertically from said upper margins; and c. displacement limiting means which coact with the walls of the car to limit movement of the section relatively to the car.

14. A cover system as defined in claim 13 in which a. the rafter and roofing plates of each section define a roof having a horizontal, planar center panel which is flanked by downward sloping, planar side panels;

b. at least some of the sections include a hatchway formed in the center panel and including a hinged cover;

c. said hatchway comprises a rectangular opening bounded by planar, vertical walls which extend upward and downward from the center panel; and d. said hinged cover comprises a flat panel which rests upon the upper margins of said vertical walls, and planar, depending walls which extend along the sides and ends of the flat panel and lie adjacent the outside faces of said vertical walls which surround the opening in the center panel.

* * * * *